United States Patent [19]

Heinzer

[11] 3,981,578

[45] Sept. 21, 1976

[54] ELECTROPHOTOGRAPHIC COPYING MACHINE WITH SEAMLESS IMAGE FORMING AND TRANSFER BAND

[75] Inventor: Paul Heinzer, Zurich, Switzerland

[73] Assignee: Wifo Wissenschaftliches Forschungs-Institut A.G., Zurich, Switzerland

[22] Filed: Feb. 11, 1975

[21] Appl. No.: 549,048

[30] Foreign Application Priority Data

Feb. 11, 1974 Switzerland ..... 1858/74

[52] U.S. Cl. ..... 355/16; 355/3 R

[51] Int. Cl.[2] ..... G03G 15/00

[58] Field of Search..... 355/16, 3 BE, 3 R, 133; 96/1.5

[56] References Cited

UNITED STATES PATENTS 3,684,368 8/1972 Tanno ..... 355/16

*Primary Examiner*—R.L. Moses

*Attorney, Agent, or Firm*—Stewart and Kolasch, Ltd.

[57] ABSTRACT

An electrophotographic copying machine which includes an endless and seamless image forming and transfer band of electrically conducting material having a coating of photoconductive material.

6 Claims, 1 Drawing Figure

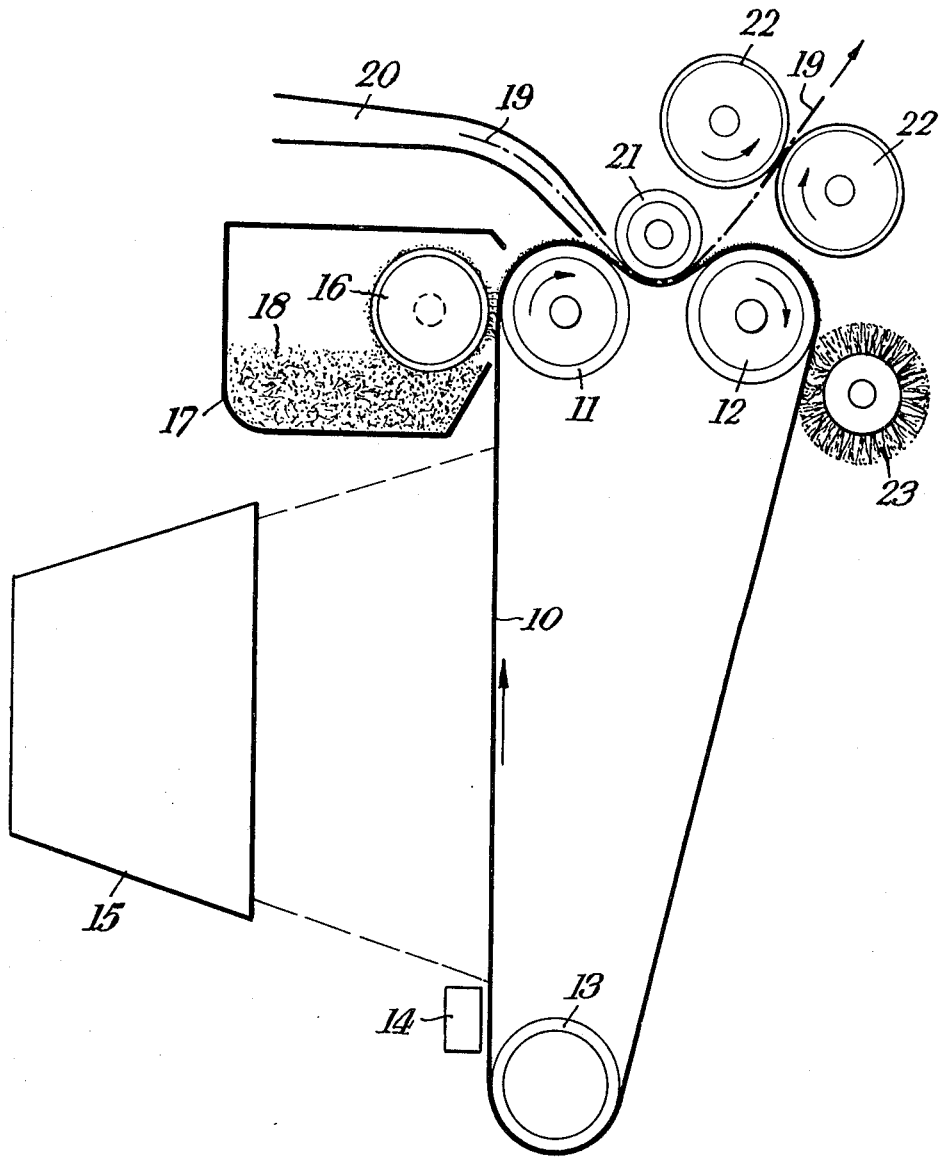
22
19
20
19
22
21
16
18
17
11
12
23
10
15
13
14

ELECTROPHOTOGRAPHIC COPYING MACHINE WITH SEAMLESS IMAGE FORMING AND TRANSFER BAND

BACKGROUND AND SUMMARY OF THE INVENTION

The present invention relates to electrophotographic copying machines, of the kind including an endless image forming and transfer band of electrically conducting material having a photoconductive coating. In use, the band travels continuously and in succession past a charging station where it receives an electrostatic charge, an exposure station where an image of an original to be copied is projected thereon, a dusting station where toner powder is applied to the electrostatic image formed on the band at the exposure station, and a transfer station where the powder image is transferred from the band to a copy sheet.

Heretofore, transfer bands have had a seam produced by joining together, e.g. by welding, the ends of a strip from material of which the band is formed. However, no matter how carefully the joint is made, it constitutes a discontinuity in the band surface and thus complications are involved in ensuring that the exposure is made on the band without the image overlapping the joint. Thus, the present invention provides an electrophotographic copying machine which includes an endless and seamless image forming and transfer band made of electrically conducting material having a coating of a photoconductive material.

The band may have a thickness of 60 to 150 $\mu$, preferably 60 to 70 $\mu$, and is preferably made of metal, for example nickel, copper, a copper alloy or a nickel-cobalt alloy. It may be made by the galvanic deposition of the metal on a suitable form followed by stripping of the deposited metal from the form.

The photoconductive layer may be amorphous selenium, chalcogenite of antimony, lead, zinc, cadmium, mercury, lead iodide or an organic photoconductor. It may be deposited on the metal by electrophoresis, spraying, coating or dipping.

BRIEF DESCRIPTION OF THE DRAWINGS

The present invention will become more fully understood from the detailed description given hereinbelow and the accompanying drawings which are given by way of illustration only, and thus are not limitative of the present invention, and wherein, by way of example, the FIGURE illustrates part of an electrophotographic copying machine.

DESCRIPTION OF THE PREFERRED EMBODIMENTS

An endless and seamless band 10 of metal having a coating of photoconductive material is trained around rollers 11, 12 and 13 of which the rollers 11, 12 are driven. The band 10 travels continuously past a corona discharge device 14 and an optical system 15 which projects on to it an image of an original, not shown. The band then moves past a magnetic brush 16, which rotates in a container 17 filled with a mixture 18 of iron fillings and particles of toner powder. The toner powder is picked up selectively by the electrostatic image of the original and is transferred to a copy sheet 19, which passes through a guide 20 and beneath a transfer roller 21 to discharge rollers 22. A brush 23 situated beyond the transfer station removes excess toner powder from the band 10.

Since the band is seamless, the machine is simplified because there is no need so to control the feed of the band so that a seam does not pass through the exposure zone. An image of size A4 can be formed on the band by a single instantaneous exposure.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What I claim as my invention and desire to secure by Letters Patent is:

1. In an electrophotographic copying machine including a charging station, an exposure station, a dusting station, and a transfer station, wherein an endless, image-forming and transfer band made of an electrically conducting material having a photoconductive coating moves continuously and in succession past said stations, said charging station imparting an electrostatic charge to said band, said exposure station projecting an image of an original onto said band, said dusting station applying toner powder to electrostatic images formed on said band at the exposure station, and said transfer station transferring toner powder images from said band to a copy sheet, the improvement which comprises providing said endless band in a form which is seamless.

2. The copying machine as claimed in claim 1, wherein said seamless, endless band is formed of a galvanically deposited metal.

3. The copying machine as claimed in claim 2, wherein said band has a thickness of 60 –150$\mu$.

4. The copying machine as claimed in claim 2, wherein said band has a thickness of 60–70$\mu$.

5. The copying machine as claimed in claim 1, wherein the band is made of a metal selected from the group consisting of nickel, copper, a copper alloy, and a nickel-cobalt alloy.

6. A copying machine as claimed in claim 1, wherein the photoconductive layer is selected from the group consisting of amorphous selenium, chalcogenite of antimony, lead, zinc, cadmium, mercury, lead iodide, and organic photoconductor.

* * * * *